US009905976B1

(12) United States Patent
Birdwell et al.

(10) Patent No.: US 9,905,976 B1
(45) Date of Patent: Feb. 27, 2018

(54) MOUNTING STRAP HAVING A CONNECTOR TO CONNECT AN ELECTRIC FIXTURE TO A JUNCTION BOX

(71) Applicant: HeathCo LLC, Bowling Green, KY (US)

(72) Inventors: Timothy Gale Birdwell, Lafayette, TN (US); Eric Colin Bretschneider, Bowling Green, KY (US); James J. Fitzgibbon, Batavia, IL (US); Bradley T. Moore, Woodburn, KY (US); Scott Blaise Tylicki, Bowling Green, KY (US)

(73) Assignee: HeathCo LLC, Bowling Green, KY (US)

( * ) Notice: Subject to any disclaimer, the term of this patent is extended or adjusted under 35 U.S.C. 154(b) by 0 days.

(21) Appl. No.: 15/427,766

(22) Filed: Feb. 8, 2017

Related U.S. Application Data

(60) Continuation of application No. 14/867,668, filed on Sep. 28, 2015, now Pat. No. 9,595,794, which is a (Continued)

(51) Int. Cl.

| | |
|---|---|
| ***H01R 13/60*** | (2006.01) |
| ***H01R 13/648*** | (2006.01) |
| ***H01R 4/66*** | (2006.01) |
| ***H01R 13/73*** | (2006.01) |
| ***H01R 24/70*** | (2011.01) |
| ***H01R 25/00*** | (2006.01) |

(Continued)

(52) U.S. Cl.
CPC ..... *H01R 13/73* (2013.01); *H01R 13/652* (2013.01); *H01R 24/70* (2013.01); *H01R 25/006* (2013.01); *H01R 43/26* (2013.01); *H01R 2103/00* (2013.01)

(58) Field of Classification Search
CPC .... H01R 23/025; H01R 13/60; H01R 13/648; H01R 13/652; H01R 13/73; H01R 13/74; H01R 23/10; H01R 24/68; H01R 24/70; H01R 25/006; H01R 27/00; H01R 31/06; H01R 33/00
USPC ..... 439/536–537, 108; 362/147–148
See application file for complete search history.

(56) References Cited

U.S. PATENT DOCUMENTS 3,695,009 A 10/1972 Osteen
4,129,383 A * 12/1978 Malinowski ..... G08B 17/107 250/574

(Continued)

OTHER PUBLICATIONS

Brinks EZ-N-Clip Instructions, Hampton Products International Corp.; (C) 2008.

(Continued)

*Primary Examiner* — Chandrika Prasad
(74) *Attorney, Agent, or Firm* — Middleton Reutlinger

(57) ABSTRACT

An electrical fixture includes an electrical fixture housing having a mounting surface, an electrical connector disposed on the mounting surface, and an electrical fixture support. A corresponding cover plate or mounting strap includes an electrical connector configured to electrically connect to hot and neutral lines from a junction box and the corresponding electrical connector disposed on the mounting surface of the electrical fixture. An electrical fixture ground connection separate from the fixture electrical connector electrically connects to an electrical ground from the junction box.

18 Claims, 8 Drawing Sheets

Related U.S. Application Data division of application No. 14/198,292, filed on Mar. 5, 2014, now Pat. No. 9,172,199.

(60) Provisional application No. 61/773,946, filed on Mar. 7, 2013, provisional application No. 61/885,261, filed on Oct. 1, 2013.

(51) Int. Cl.

| | |
|---|---|
| ***H01R 43/26*** | (2006.01) |
| ***H01R 13/652*** | (2006.01) |
| *H01R 103/00* | (2006.01) |

(56) References Cited

U.S. PATENT DOCUMENTS

| | | | | |
|---|---|---|---|---|
| 5,574,256 | A | 11/1996 | Cottone | |
| 6,641,278 | B1 * | 11/2003 | Guritz | F21V 21/03 362/147 |
| 6,676,442 | B2 * | 1/2004 | Kerr, Jr. | H02G 3/20 362/147 |
| 6,780,049 | B1 * | 8/2004 | D'Angelo | F04D 29/601 439/313 |
| 7,009,514 | B2 | 3/2006 | Dupeire | |
| 7,462,066 | B2 * | 12/2008 | Kohen | F21V 21/03 439/537 |
| 7,985,017 | B2 | 7/2011 | Quan | |
| 7,997,324 | B2 | 8/2011 | Olmsted | |
| 8,727,804 | B2 | 5/2014 | McNeely et al. | |
| 9,172,199 | B2 * | 10/2015 | Birdwell | H01R 43/26 |
| 9,595,794 | B2 * | 3/2017 | Birdwell | H01R 43/26 |
| 2002/0142650 | A1 | 10/2002 | Clark et al. | |
| 2002/0197910 | A1 * | 12/2002 | Kerr, Jr. | H01R 33/09 439/535 |
| 2006/0073731 | A1 | 4/2006 | Chien | |
| 2009/0107693 | A1 | 4/2009 | Meyer | |
| 2010/0084184 | A1 | 4/2010 | Phillips | |
| 2013/0255988 | A1 | 10/2013 | Phillips | |
| 2014/0256179 | A1 | 9/2014 | Birdwell | |

OTHER PUBLICATIONS

Kidde; United Technologies; User Guide for Model i120105 Ionization Smoke Alarm; Written at least as early as Feb. 20, 2014.

ZST/8R; Securetone Conventional Electronic Sounder; Issue No. 1; Last Update May 17, 2007.

* cited by examiner

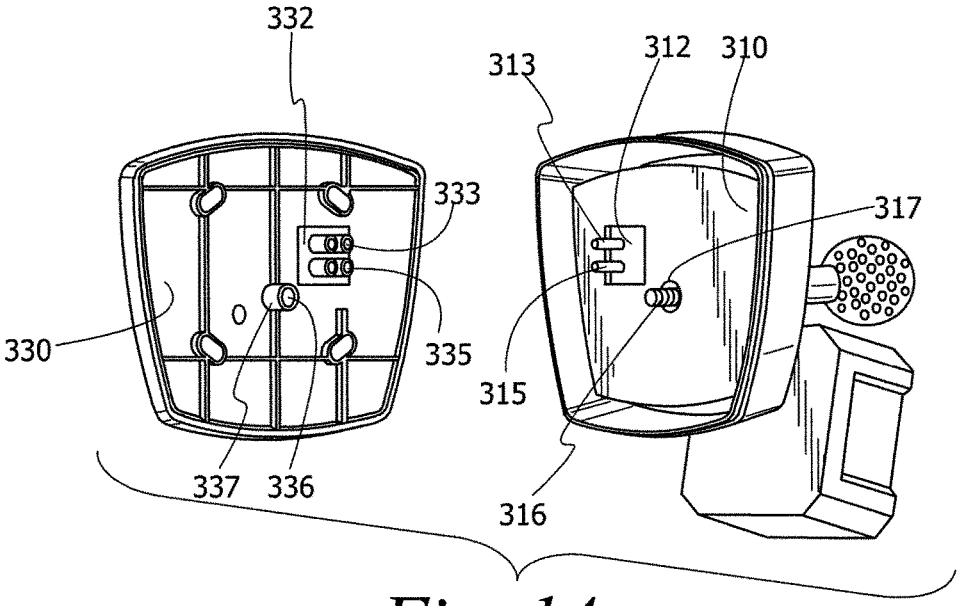
Fig. 14
Fig. 15
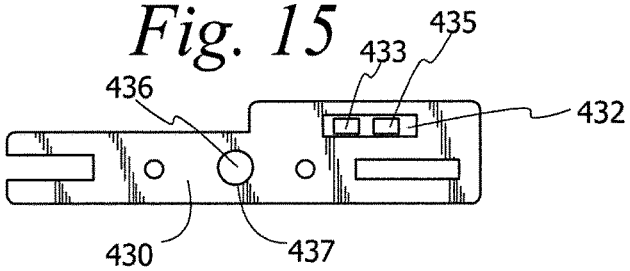
Fig. 16
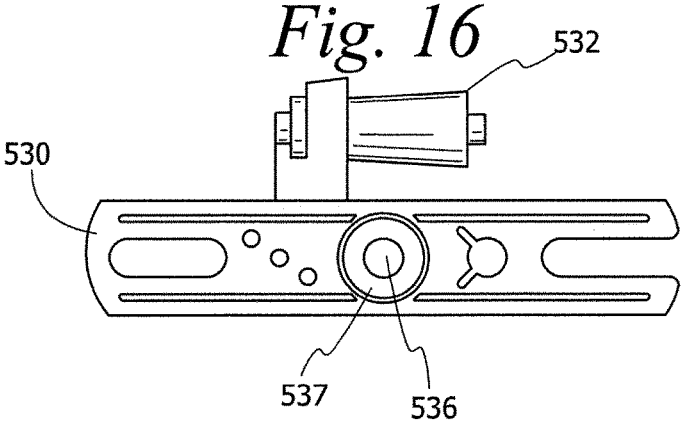

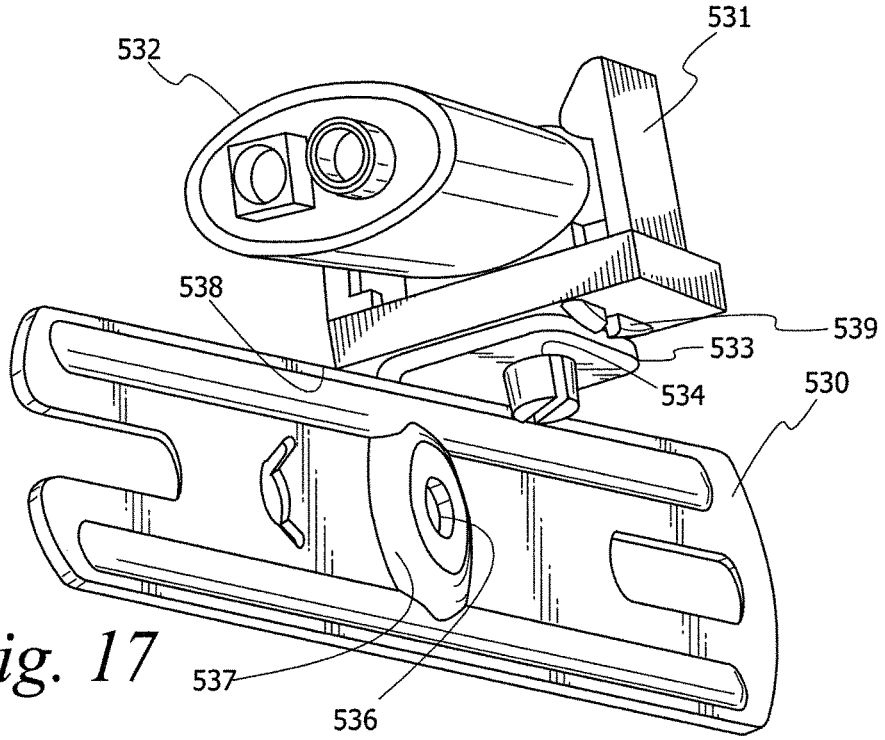
Fig. 17
Fig. 18
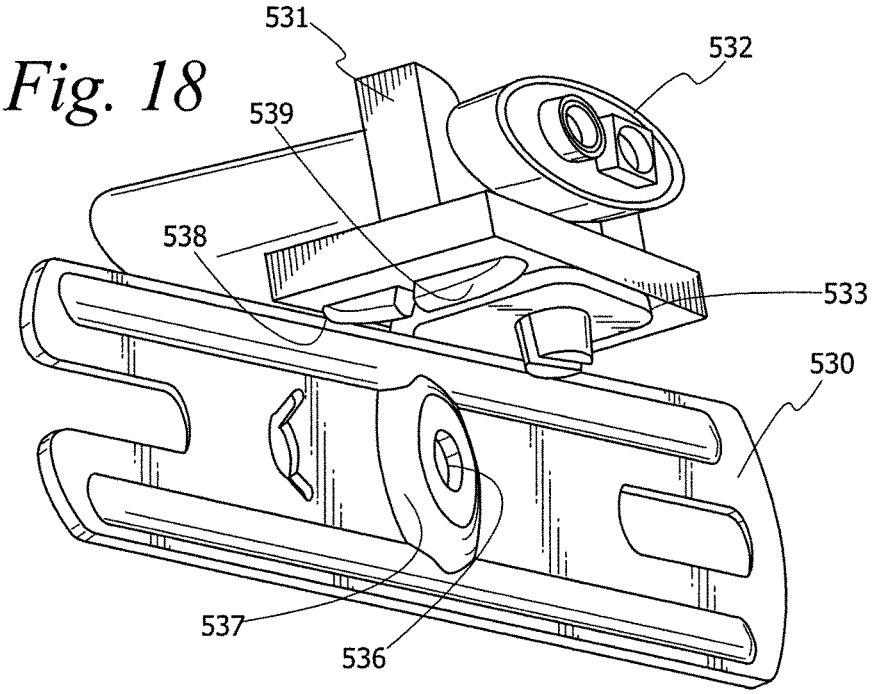

MOUNTING STRAP HAVING A CONNECTOR TO CONNECT AN ELECTRIC FIXTURE TO A JUNCTION BOX

TECHNICAL FIELD

This invention relates generally to an electrical fixture, and more specifically to apparatuses and methods for quickly connecting the electrical fixture to an electrical power connection.

BACKGROUND

Electrical fixture or luminary systems are generally known in the industry. General examples of such a system are indoor or outdoor lighting fixtures, of which there are several different styles. For example, some lighting fixtures may include single or multiple light bulbs as well as motion sensors which are configured to illuminate the lights when motion is detected in a predetermined area. An electrical junction box is oftentimes used to provide these fixtures with electrical power. These junction boxes generally are attached to a side of a building, and include hot (or live), neutral, and ground wires. When a junction box is used, the installer of the lighting fixture must properly couple this wiring from the junction box to the electrical fixture.

In certain configurations, it may be burdensome for the installer to connect the electrical wiring from the junction box to the lighting fixture. For example, the installer may have to hold the lighting fixture with one hand and connect the wiring from the fixture with their other hand. Because of this, there may be a limited amount of space for the installer work with when coupling the wiring. The electrical wiring may also be a predetermined length, again requiring the installer to work in limited space. Upon connecting the wiring from the junction box to the lighting fixture, the installer still must secure the lighting fixture to the junction box.

SUMMARY

Generally speaking, pursuant to these various embodiments, a cover plate, mounting strap or other suitable structure is designed to be readily connected to hot and neutral lines from a junction box and be secured to the junction box. Because a cover plate or mounting strap is relatively small and light, this is readily accomplished by the user. Then, an electrical fixture includes a mounting aspect that readily and easily mounts to the cover plate or mounting strap, which mounting also effects the electrical connection of the hot and neutral between the fixture and the junction box via the cover plate. Ground may be separately carried through a press fit with the cover plate or junction box or through a support structure such as a screw that secures the fixture to the cover plate. So configured, an installer need not hold the fixture while connecting the various electrical wires. Instead, the electrical connection is readily effected during physically mounting the fixture. This improves ease of use for the installer. These and other benefits may be recognized through study of the following drawings and description.

In one example, an electrical fixture apparatus having a mounting surface and a support mounts to a cover plate configured to mount to a junction box. The support then secures the electrical fixture to the cover plate when mounted. In one approach, the mounting surface of the electrical fixture includes a fixture electrical connector that electrically connects with an electrical connector on the cover plate. The electrical connector on the cover plate electrically connects to the hot and neutral lines from the junction box. In this approach, the electrical fixture includes an electrical fixture ground connection separate from the hot and neutral line connector to electrically connect to electrical ground from the junction box. In some configurations, the ground connection is carried to the electrical fixture from the cover plate through the electrical fixture support.

Thus, various approaches to such an electrical fixture may provide reduced installation times as well as ease of installation. This ease of installation may additionally reduce user effort required to couple the electrical fixture to the junction box. Further, by carrying the ground connection through the electrical fixture support to the junction box, the installer is able to combine the steps of securing the electrical fixture to ground and grounding the electrical fixture. In one example, the cover plate further includes a grounded cover plate portion separate from the electrical connector that is configured to electrically connect to electrical ground at the junction box and to electrically connect the electrical fixture ground connection to the electrical ground. In some examples, the grounded cover plate portion electrically connects the electrical fixture ground connection to electrical ground through a mechanical connection between the grounded cover plate portion and a portion of the electrical fixture housing upon mounting the electrical fixture to the junction box. In other examples, the grounded cover plate portion electrically connects the electrical fixture ground connection to electrical ground through a mechanical support of the cover plate which includes the grounded cover plate portion, where the mechanical support secures the electrical fixture through connection to the fixture support. In some examples, the electrical fixture support includes a screw configured to engage a portion of the junction box when mounted to the junction box to electrically connect the electrical fixture ground to electrical ground.

In some applications, the mounting surface of the electrical fixture and the cover plate each include at least one flanged portion spaced apart from the mounting surface and the cover plate, respectively, which are configured to slidably mate with each other. In these embodiments, a portion of the fixture electrical connector may be disposed on the flanged portion of the mounting surface, and the electrical connector of the cover plate is disposed on the flanged portion of the cover plate. Thus, when the two flanged portions slidably mate with one another, the fixture electrical connector is electrically connected to the available electrical connections of the junction box.

In other applications, the flanged portions of the mounting surface and the cover plate are configured to rotatably mate with each other. As in previous embodiments, a portion of the fixture electrical connector may be disposed on the flanged portion of the mounting surface, and the electrical connector of the cover plate is disposed on the flanged portion of the cover plate. Thus, when the two flanged portions rotatably mate with one another, the fixture electrical connector is electrically connected to the electrical connections of the junction box.

In another aspect, both the mounting surface and the cover plate can include push-on connectors configured to mate with each other during mounting of the fixture.

In another aspect, related methods of mounting an electrical fixture to a cover plate junction are provided.

BRIEF DESCRIPTION OF THE DRAWINGS

The above needs are at least partially met through provision of the electrical fixture connection described in the following detailed description, particularly when studied in conjunction with the drawings, wherein:

FIG. 14 comprises a perspective view of a third alternative example cover plate and electrical fixture mounting surface as configured in accordance with various embodiments of the invention;

FIG. 15 comprises a front elevation view of an alternative example mounting mechanism to connect to a junction box as configured in accordance with various embodiments of the invention;

FIG. 16 comprises a front elevation view an alternative example mounting mechanism to connect to a junction box as configured in accordance with various embodiments of the invention;

FIG. 17 comprises a rear perspective view the alternative example mounting mechanism of FIG. 16 to connect to a junction box as configured in accordance with various embodiments of the invention;

FIG. 18 comprises a rear perspective view the alternative example mounting mechanism of FIG. 16 to connect to a junction box as configured in accordance with various embodiments of the invention;

Skilled artisans will appreciate that elements in the figures are illustrated for simplicity and clarity and have not necessarily been drawn to scale. For example, the dimensions and/or relative positioning of some of the elements in the figures may be exaggerated relative to other elements to help to improve understanding of various embodiments of the present invention. Also, common but well-understood elements that are useful or necessary in a commercially feasible embodiment are often not depicted in order to facilitate a less obstructed view of these various embodiments. It will further be appreciated that certain actions and/or steps may be described or depicted in a particular order of occurrence while those skilled in the art will understand that such specificity with respect to sequence is not actually required. It will also be understood that the terms and expressions used herein have the ordinary technical meaning as is accorded to such terms and expressions by persons skilled in the technical field as set forth above except where different specific meanings have otherwise been set forth herein.

DETAILED DESCRIPTION

Figure 1:
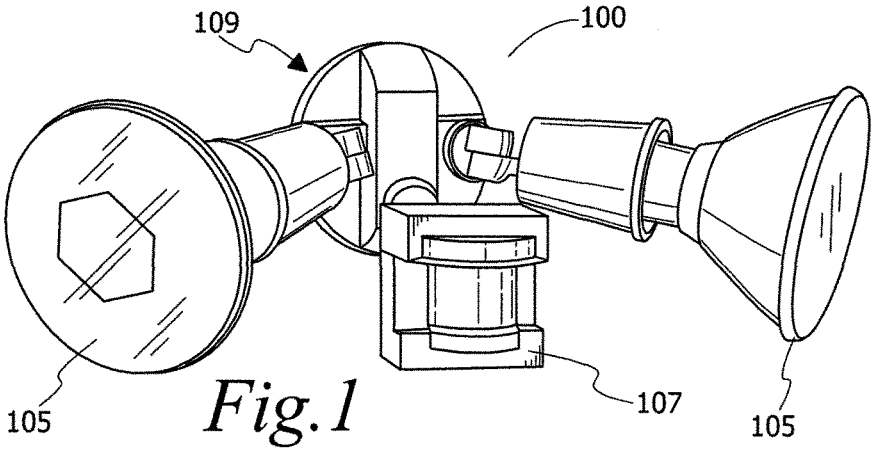
FIG. 1 comprises a perspective view of an example lighting fixture as configured in accordance with various embodiments of the invention.
Figure 2:
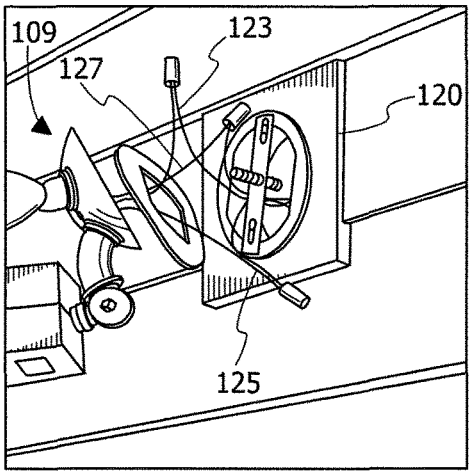
Fig. 2 PRIOR ART
FIG. 2 comprises a perspective view of a prior art electrical connection between a lighting fixture and a junction box.
Figure 3:
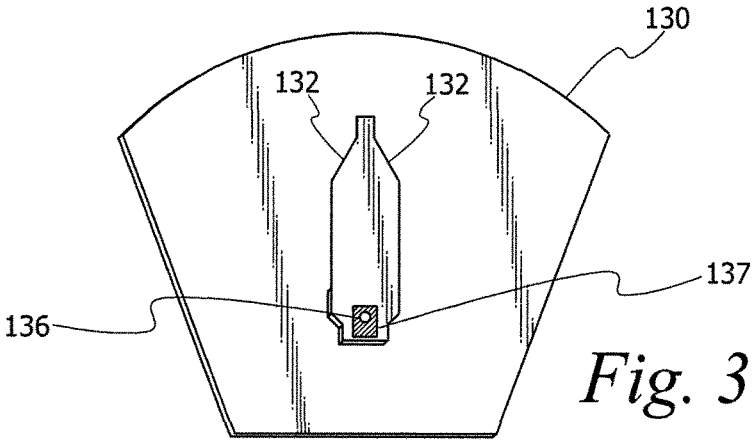
FIG. 3 comprises a front elevation view of an example cover plate as configured in accordance with various embodiments of the invention.
Figure 4:
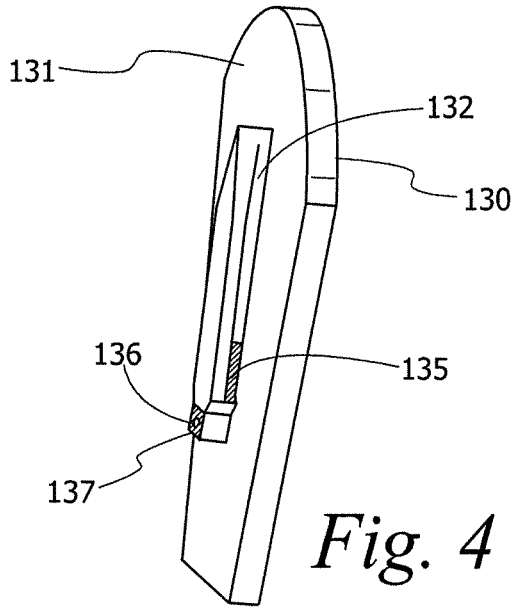
FIG. 4 comprises a perspective view of the example cover plate of FIG. 3 as configured in accordance with various embodiments of the invention.
Figure 5:
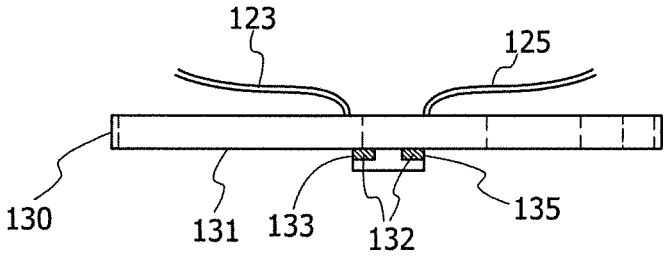
FIG. 5 comprises a top plan view the example cover plate of FIGS. 3-4 as configured in accordance with various embodiments of the invention.
Figure 6:
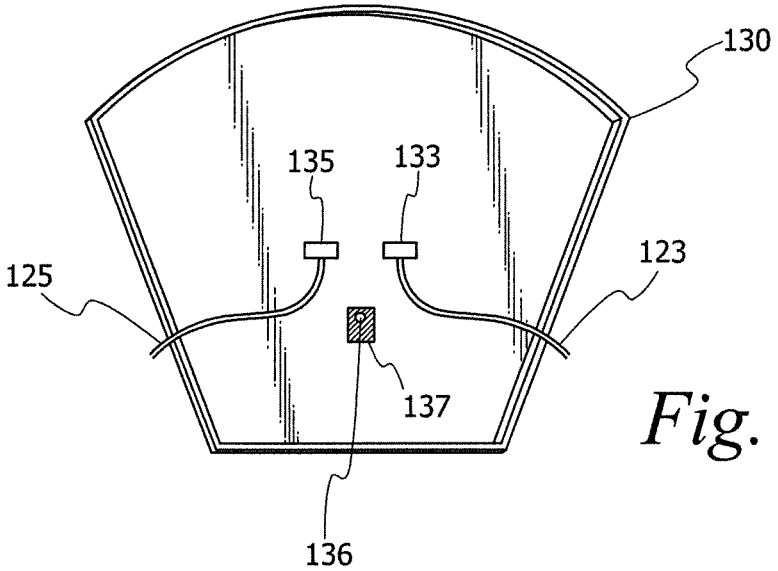
FIG. 6 comprises a rear elevation view of the example cover plate of FIG. 3 as configured in accordance with various embodiments of the invention.

Referring now to the drawings, and in particular to FIGS. 1 and 2, an example electrical fixture 100 is provided. The electrical fixture 100 can include, for example, an electrical fixture housing 109, a lighting element 105, and a motion sensor 107. As seen in FIG. 2, three wires extend from the junction box 120, which represent hot 123, neutral or common 125, and ground 127 wires. As previously mentioned, in existing systems, the individual installing the light fixture 100 was oftentimes tasked with connecting the wires extending from the junction box to the light fixture using any of a number of generally known connectors.

Turning now to FIGS. 3-6, an example of a cover plate 130 is provided in further detail. In this example, the cover plate 130 includes a surface 131, electrical connectors 133, 135 configured to electrically connect to hot and neutral wires, 123, 125, respectively, from the junction box 120. In various approaches, the cover plate 130 may instead include wires electrically connected to the electrical connectors 133, 135 that can in turn be connected to corresponding wires from the junction box 120. In some examples, the cover plate 130 further includes a grounded cover plate portion 137 separate from the electrical connectors 133, 135 configured to electrically connect to the electrical ground of the junction box 120. For example, this portion 137 may include a wire or other connector able to electrically connect to the electrical ground wire 127 at the junction box 120. It is understood that in this example, any commonly known method of electrically connecting a wire is provided for, including, but not limited to, clamping, soldering, clipping, the use of screw terminals, insulation displacement connections, control block style pushing arrangements, or any other method or apparatus. Similarly, the electrical ground connection can be carried by the physical connection between the cover plate and the junction box 120 where the junction box 120 is a grounded electrical conductor and the cover plate carries an electrically conductive structure that mates to the junction box 120 when mounted.

In some examples, the cover plate 130 mounts onto the junction box 120 through any number of connections, for example screwing, gluing, stapling, nailing, or any other method employed by users having skill in the relevant art. In some embodiments, the cover plate 130 serves as a water-tight seal with the junction box 120, thus may reduce or eliminate water from entering into the junction box 120.

In some examples, the cover plate 130 further includes at least one flanged portion 132. This flanged portion 132 is spaced apart from the surface 131 and away from the junction box 120 to allow for mounting of the electrical fixture 100 as discussed in further detail below.

It is understood that the cover plate 130 discussed herein may be made of a metal, plastic, or other similar materials utilized by those having skill in the art. If the cover plate 130 is made of a metal or similar electrically conductive material, it is possible that the grounded cover plate portion 137 may include the entire cover plate. In such a scenario, the cover plate electrical connectors 133, 135 must be electrically insulated from the grounded cover plate portion 137 so as to avoid a short circuit at the junction box 120. In the event the cover plate 130 is made of a non-electrically conductive material, a separate grounded strap portion 137 must be provided.

Figure 7:
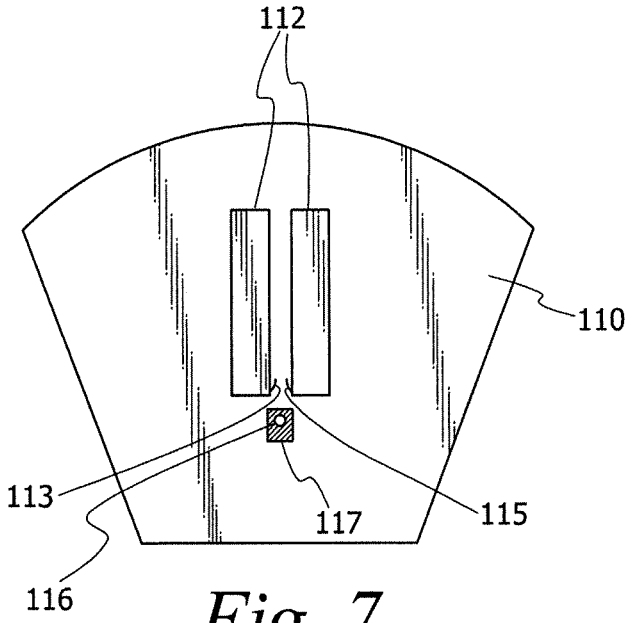
FIG. 7 comprises a front elevation view of an electrical fixture mounting surface configured to mount on the example cover plate of FIG. 3 as configured in accordance with various embodiments of the invention.
Figure 8:
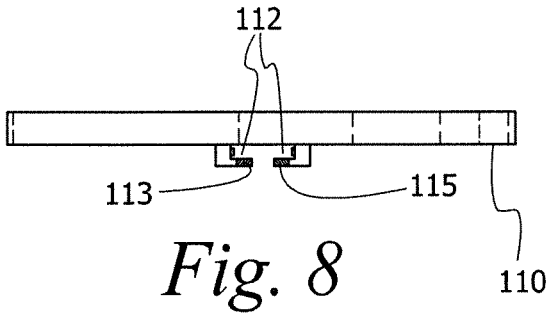
FIG. 8 comprises a top plan view of the electrical fixture mounting surface of FIG. 7 as configured in accordance with various embodiments of the invention.

Turning now to FIGS. 7 and 8, an example of a mounting surface 110 of the electrical fixture 100 is provided in further detail. The mounting surface 110 includes electrical connectors 113, 115 disposed thereon that electrically connect to hot and neutral wires (not shown) contained within the electrical fixture 100 to provide power. It is understood that the internal connection of the hot and neutral within the electrical fixture is well known by individuals having skill in the relevant art, thus such connecting methods and apparatuses will not be discussed in further detail.

In some examples, the mounting surface 110 further includes an electrical fixture support 116 configured to secure the electrical fixture 100 to the junction box 120 when mounted. As illustrated in FIG. 7, the electrical fixture support 116 may simply be a hole through which a screw or bolt (not shown) passes to secure or connect to a corresponding portion of the cover plate 130 as described below. The electrical fixture support 116 may be a portion of the electrical fixture grounded portion 117 to allow for electrical ground to be connected thereto.

The electrical fixture grounded portion 117 is separate from the fixture electrical connectors 113, 115, and electrically connects to ground contained within the electrical fixture 100. It is understood that connecting the electrical fixture ground portion 117 to the electrical fixture ground is well known by individuals having skill in the relevant art, thus connecting methods and apparatuses will not be discussed in further detail.

Generally speaking, when mounting the electrical fixture 100 to the cover plate 130 and thus the junction box 120, the electrical fixture electrical connectors 113, 115 mate with the electrical connectors 133, 135 contained on the cover plate 130, thus creating an electrical connection for hot and neutral wires between the electrical fixture 100 and the junction box 120. Furthermore, the electrical fixture grounded portion 117 electrically connects to an electrical ground from the junction box 120.

In one approach, the electrical fixture mounting surface 110 includes at least one flanged portion 112 spaced apart from the mounting surface 110. In this approach, the flanged portion 112 allows the electrical fixture 100 to at least temporarily be mounted to the junction box 120 in a manner described below.

Referring now to FIGS. 3-8, one approach to mounting the electrical fixture 100 to the junction box 120 is herein described. In this approach, once the cover plate 130 is mounted and electrically wired to the junction box 120 in any of the above-described manners, the flanged portion 112 of the electrical fixture mounting surface 110 slidably mates with at least a portion of the corresponding flanged portion 132 of the cover plate 130. In this approach, the electrical fixture 100 is thereby at least temporarily mounted to the junction box 120.

In some approaches, the flanged portions 112, 132 include at least a portion of the electrical connectors 113, 115, 133, 135. Thus, during mounting of the electrical fixture, when the flanged portions 112, 132 of the electrical fixture mounting surface 110 and the cover plate 130 slidably mate with each-other, the electrical fixture electrical connectors 113, 115 and the cover plate electrical connectors 133, 135 come into direct contact whereby the cover plate electrical connectors 133, 135 mate with the electrical fixture electrical connectors 113, 115. This direct contact allows the hot and neutral wires of electrical fixture 100 to be electrically connected to the corresponding hot 123 and neutral 125 wires of the junction box 120.

In one approach, the electrical fixture grounded portion 117 is directly electrically connected to the ground wire 127 through any method known to individuals having skill in the relevant art. In another approach, the electrical fixture support 116 may include a conventional screw (not shown) that engages a portion of the junction box 120 when the electrical fixture is mounted to the junction box to electrically connect the screw to electrical ground. The screw thus electrically connects the electrical fixture ground connection to electrical ground.

In still another approach, the electrical fixture grounded portion 117 is electrically connected to the ground wire 127 by mechanically connecting with the grounded cover plate portion 137 which in turn is electrically connected to the ground wire 127 from the junction box 120. In one example of this approach, a surface of the grounded cover plate portion 137 is electrically conductive and comes into physical contact with a corresponding electrically conductive surface of the electrical fixture grounded portion 117 to form an electrical connection. In some examples, these surfaces are both metallic, but it is appreciated that any electrically conductive material may be utilized.

In yet another approach, the grounded cover plate portion 137 of the cover plate 130 includes a mechanical support 136. In this approach, the electrical fixture 100 is mechanically secured to the junction box 120 through connection of the electrical fixture support 116 to the mechanical support 136 of the grounded cover plate portion 137 of the cover plate 130. By mechanically securing the electrical fixture 100 to the cover plate 130 in this manner, the grounded cover plate portion 137 electrically connects electrical ground to the electrical fixture.

For example, the mechanical support 136 can be configured to receive a screw (not shown) of the electrical fixture support 136 to secure the electrical fixture 100 to the cover plate 130. In this approach, the mechanical support 136 is further configured to connect electrical ground to the screw. This may occur through the use of an electrically conducting mechanical support portion which electrically connects the electrical ground connection from the junction box 120 and the screw which is in turn in electrical connection with the electrical fixture support 116.

It is understood that in some examples, both the mechanical connection between the grounded cover plate portion 137 and the electrical fixture grounded portion 117 as well as mechanically securing the electrical fixture 100 to the mechanical support 136 of the cover plate may be utilized to connect electrical ground from the junction box 120 to the electrical fixture 100.

With regards to FIGS. 9-13, an alternative approach is illustrated. It is understood that elements contained in FIGS. 9-13 that are similar to those in FIGS. 3-8 will end in the same two-digit suffix and only differ by the leading digit. For example, in FIG. 9, an electrical fixture mounting surface 210 is provided. Furthermore, identical features such as the junction box 120 and hot, neutral and ground wires 123, 125, 127 will retain the same reference numerals previously utilized.

Figure 9:
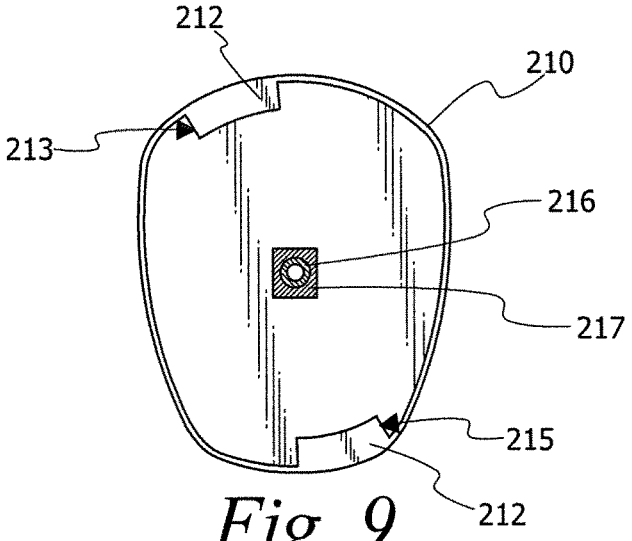
FIG. 9 comprises a front elevation view of an alternative example electrical fixture mounting surface as configured in accordance with various embodiments of the invention.
Figure 10:
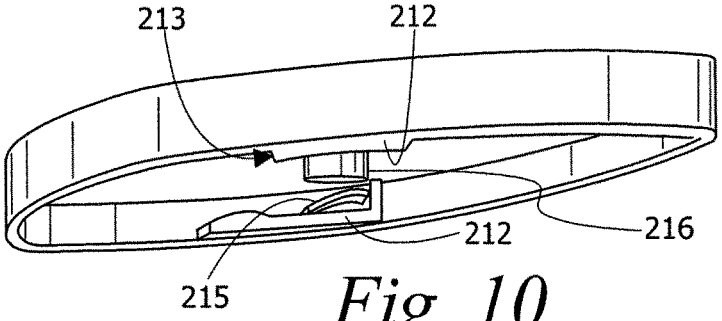
FIG. 10 comprises a perspective view of the alternative electrical fixture mounting surface of FIG. 9 as configured in accordance with various embodiments of the invention.

Turning briefly to FIGS. 9-10, an alternative example of a mounting surface 210 of an electrical fixture is herein provided. The mounting surface 210 includes electrical connectors 213, 215 disposed thereon that electrically connect to hot and neutral wires (not shown) contained within the electrical fixture 100 to provide power. As before, it is understood that connecting the hot and neutral wires to the electrical fixture is well known by individuals having skill in the relevant art; thus connecting methods and apparatuses will not be discussed in further detail.

In some examples, the mounting surface 210 further includes an electrical fixture support 216 configured to secure the electrical fixture 100 to the junction box 120 when mounted. As seen in FIG. 9, the electrical fixture support 216 may simply be a hole for accepting a screw or bolt (not shown) to secure to a corresponding portion of the cover plate 230 as described below. The electrical fixture support 216 may be a portion of the electrical fixture grounded portion 217 to allow for electrical ground to be connected thereto.

The electrical fixture grounded portion 217 is separate from the fixture electrical connectors 213, 215, and is configured to electrically connect to ground contained within the electrical fixture 100. It is understood that connecting the electrical fixture ground portion 217 to the electrical fixture ground is well known by individuals having skill in the relevant art; thus connecting methods and apparatuses will not be discussed in further detail.

In one approach, the electrical fixture mounting surface 210 includes at least one flanged portion 212 spaced apart from the mounting surface 210. In this approach, the flanged portion 212 allows the electrical fixture 100 to at least temporarily be mounted to the junction box 120 in a manner described below.

Figure 11:
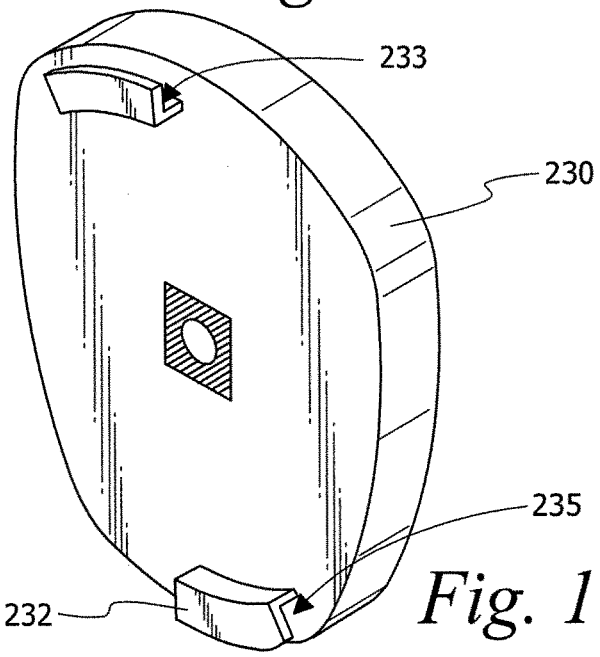
FIG. 11 comprises a perspective view of an alternative example cover plate configured to mate with the electrical fixture mounting surface of FIG. 9 as configured in accordance with various embodiments of the invention.
Figure 12:
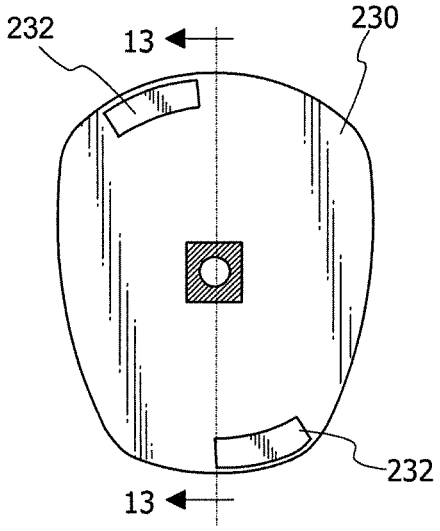
FIG. 12 comprises a front elevation view of the alternative cover plate of FIG. 11 as configured in accordance with various embodiments of the invention.
Figure 13:
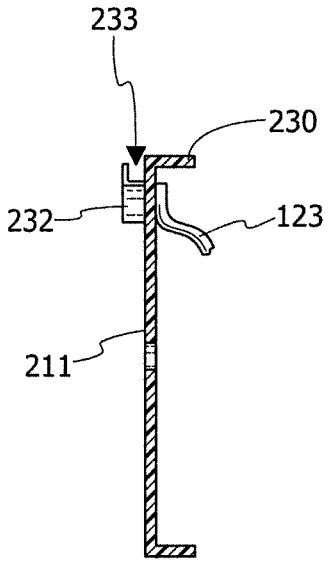
FIG. 13 comprises a cross-sectional view of the alternative cover plate of FIG. 11 as configured in accordance with various embodiments of the invention.
Figure 19:
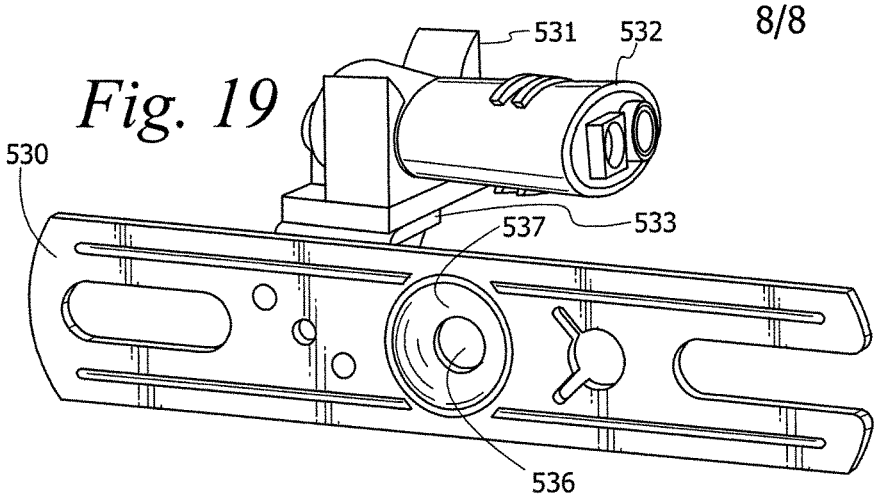
FIG. 19 comprises a front perspective view the alternative example mounting mechanism of FIG. 16 to connect to a junction box as configured in accordance with various embodiments of the invention.

Turning now to FIGS. 11-13, an example of a cover plate 230 is provided in further detail. In this example, the cover plate 230 includes a surface 231 and electrical connectors 233, 235 configured to electrically connect to hot 123 and neutral (not shown) wires from the junction box 120. In some examples, the cover plate 230 further includes a grounded cover plate portion 237 separate from the electrical connectors 233, 235 configured to electrically connect to the electrical ground wire 127 at the junction box 120. It is understood that in this example, any commonly known method of electrically connecting a wire is provided for, including, but not limited to, clamping, soldering, clipping, the use of screw terminals, insulation displacement connections, control block style pushing arrangements, or any other method or apparatus.

In some examples, the cover plate 230 mounts onto the junction box 120 through any number of connections, for example screwing, gluing, stapling, nailing, or any other method employed by users having skill in the relevant art. In some embodiments, the cover plate 230 serves as a water-tight seal with the junction box 120, which may reduce or eliminate water from entering into the junction box 120.

In some examples, the cover plate 230 further includes at least one flanged portion 232. This flanged portion 232 is spaced apart from the surface 231 to allow for mounting of the electrical fixture 100 which is discussed in further detail below.

It is understood that the cover plate 230 discussed herein may be made of a metal, plastic, or other similar materials utilized by those having skill in the art. If the cover plate 230 is made of a metal or similar electrically conductive material, it is possible that the grounded cover plate portion 237 may include the entire cover plate. In such a scenario, the cover plate electrical connectors 233, 235 must be electrically insulated from the grounded cover plate portion 237 so as to avoid a short circuit at the junction box 120. In the event the cover plate 230 is made of a non-electrically conductive material, a separate grounded strap portion 237 must be provided.

Referring again to FIGS. 9-13, generally speaking, when mounting the electrical fixture 100 to the cover plate 230 and thus the junction box 120, the flanged portion 212 of the mounting surface 210 is configured to be rotatably secured to at least a portion of the flanged portion 232 of the cover plate 230. In one example, this rotatable connection can be considered a bayonet mount approach.

In one approach, the flanged portions 212, 232 include at least a portion of the electrical connectors 213, 215, 233, 235. Thus, during mounting of the electrical fixture, when the flanged portions 212, 232 of the electrical fixture mounting surface 210 and the cover plate 230 rotatably mate with each-other, the electrical fixture electrical connectors 213, 215 and the cover plate electrical connectors 233, 235 come into direct contact whereby the cover plate electrical connectors 233, 235 mate with the electrical fixture electrical connectors 213, 215. This direct contact allows the hot and neutral wires of electrical fixture 100 to be electrically connected to the corresponding hot 123 and neutral 125 wires of the junction box 120.

It is understood that connecting the electrical fixture 100 to electrical ground in the junction box 120 occurs in the same manner as provided in the previous embodiment, and may include the electrical fixture grounded portion 217, the electrical fixture support 217, the grounded cover plate portion 237, and the mechanical support 236. Thus, for the sake of brevity, further details are not provided.

With regards to FIG. 14, an alternative embodiment is herein provided. It is understood that elements contained in FIG. 14 that are similar to those in the previous embodiments will end in the same two-digit suffix and only differ by the leading digit. For example, in FIG. 12, an electrical fixture mounting surface 310 is provided. Furthermore, identical features such as the junction box 120 and hot, neutral and ground wires 123, 125, 127 will retain the same reference numerals previously utilized.

Turning to FIG. 14, an alternative example of an electrical fixture mounting connection 310 of an electrical fixture is herein provided. The mounting surface 310 includes an electrical fixture push-on connector 312 having electrical connectors 313, 315 disposed thereon that electrically connect to hot and neutral wires (not shown) contained within the electrical fixture 100 to provide power. As before, it is understood that connecting the hot and neutral wires to the electrical fixture is well known by individuals having skill in the relevant art; thus connecting methods and apparatuses will not be discussed in further detail.

The mounting surface 310 further includes an electrical fixture support 316 configured to secure the electrical fixture 100 to the junction box 120 when mounted. The electrical fixture support 316 may simply be a hole for accepting a screw or bolt to secure with a corresponding portion of the cover plate 330 as described below. The electrical fixture support 316 may be a portion of the electrical fixture grounded portion 317 to allow for electrical ground to be connected thereto.

The electrical fixture grounded portion 317 is separate from the fixture electrical connectors 313, 315, and is configured to electrically connect to ground contained within the electrical fixture 100. It is understood that connecting the electrical fixture ground portion 317 to the electrical fixture ground is well known by individuals having skill in the relevant art, thus connecting methods and apparatuses will not be discussed in further detail.

The electrical fixture push-on connector 312 allows the electrical fixture 100 to at least temporarily be mounted to the junction box 120 in a manner described below.

The cover plate 330 includes electrical connectors 333, 335 configured to electrically connect to hot and neutral wires (not shown) from the junction box 120. In some examples, the cover plate 330 further includes a grounded cover plate portion 337 separate from the electrical connectors 333, 335 configured to electrically connect to the electrical ground wire 127 at the junction box 120. It is understood that in this example, any commonly known method of electrically connecting a wire is provided for, including, but not limited to, clamping, soldering, clipping, the use of screw terminals, insulation displacement connections, control block style pushing arrangements, or any other method or apparatus.

The cover plate 330 mounts onto the junction box 120 through any number of connections, for example screwing, gluing, stapling, nailing, or any other method employed by users having skill in the relevant art. In some embodiments, the cover plate 330 serves as a water-tight seal with the junction box 120, which may reduce or eliminate water from entering into the junction box 120.

It is understood that the cover plate 330 discussed herein may be made of a metal, plastic, or other similar materials utilized by those having skill in the art. If the cover plate 330 is made of a metal or similar electrically conductive material, it is possible that the grounded cover plate portion 337 may include the entire cover plate. In such a scenario, the cover plate electrical connectors 333, 335 must be electrically insulated from the grounded cover plate portion 337 so as to avoid a short circuit at the junction box 120. In the event the cover plate 330 is made of a non-electrically conductive material, a separate grounded strap portion 237 must be provided.

In some examples, the cover plate 330 further includes a push-on connector 332. This push-on connector 332 allows for mounting of the electrical fixture 100. Generally speaking, when mounting the electrical fixture 100 to the cover plate 330 and thus the junction box 120, the push-on connectors 312, 332 mate with each-other to be secured.

In some examples, the push-on connectors 312, 332 include at the electrical connectors 313, 315, 333, 335. Thus, during mounting of the electrical fixture, when the push-on connectors 312, 332 of the electrical fixture mounting surface 310 and the cover plate 330 mate with each-other, the electrical fixture electrical connectors 313, 315 and the cover plate electrical connectors 333, 335 come into direct contact whereby the cover plate electrical connectors 333, 335 mate with the electrical fixture electrical connectors 313, 315. This direct contact allows the hot and neutral wires of electrical fixture 100 to be electrically connected to the corresponding hot 123 and neutral 125 wires of the junction box 120.

It is understood that connecting the electrical fixture 100 to electrical ground in the junction box 120 occurs in the same manner as provided in the previous embodiments, and may include the electrical fixture grounded portion 317, the electrical fixture support 316, the grounded cover plate portion 337, and the mechanical support 336. Thus, for the sake of brevity, further details are not provided.

FIGS. 15-20 show alternative embodiments to the cover plate 330 discussed above. In these alternative embodiments, a strap is utilized to electrically connect to the hot 123, neutral 125, and ground 127 wires of the junction box 120.

In FIG. 15, the strap 430 includes a push-on connector 432 having strap electrical connectors 433, 435, which are configured to electrically connect to hot and neutral wires 123, 125, respectively, from the junction box 120 using conventional methods. The strap further includes a grounded strap portion 437 and a mechanical support 436. For instance the body of the strap 430 can be metal and conduct ground from a press fit with a metal and grounded junction box 120. Thus, when a screw from the fixture secures to the mechanical support 436 of the strap 430, electrical ground is conducted through the screw to the fixture.

As described in the embodiment depicted by FIG. 14, the electrical fixture 100 mounts to the strap 430 in a similar manner. In other words, the push-on connector 312 of the electrical fixture 100 is configured to mate to the push-on connector 432 of the strap 430 during mounting of the electrical fixture 100 to the junction box 120.

In FIGS. 16-20, one example strap 530 includes a longitudinal axis defined by the longitudinal strap body, a rotatable mount 531 supported by the mounting strap 530, an electrical push-on connector 532 supported by the rotatable mount, a grounded strap portion 537 and a mechanical support 536. As before, the mounting strap 530 is configured to mount to the junction box and a portion of a mounting surface of the electrical fixture. In this embodiment, the electrical or push-on connector 532 is rotatably secured to the strap 530.

In this approach, the strap 530 includes a flanged portion 533 extending obliquely to the longitudinal axis of the mounting strap to which the push-on connector 532 secures. As seen in the example of FIGS. 17 and 18, the flanged portion 533 defines an aperture 534 configured to receive a portion of the rotatable mount 531. This portion may be snap or press fit into the aperture 534. It is understood that other known methods of rotatably securing the rotatable mount 534 to the flanged portion 533 may be used. In another approach, the electrical connector 532 may be integrally formed with the rotatable mount 531. As described below, the rotatable mount 531 is configured to rotate about the portion of the rotatable mount engaging the aperture of the flanged portion.

Figure 20:
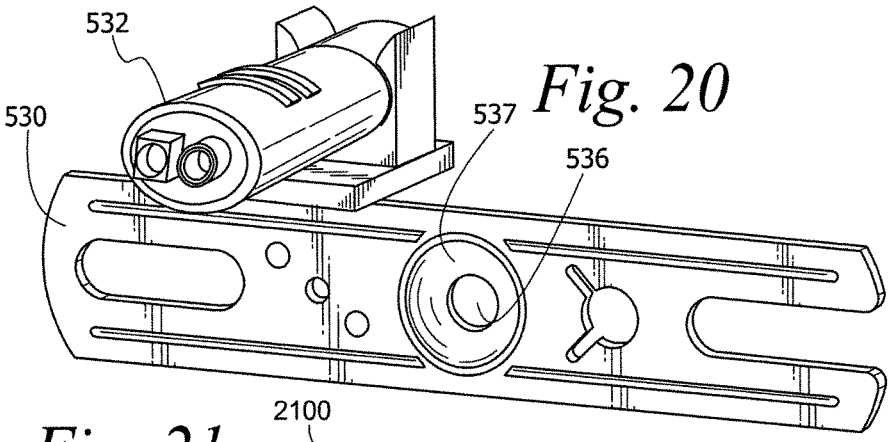
FIG. 20 comprises a front perspective view the alternative example mounting mechanism of FIG. 16 to connect to a junction box as configured in accordance with various embodiments of the invention.

When the strap 530 is mounted to the junction box, the rotatable mount is configured to rotate to a first position such that the electrical connector extends outwardly from the junction box and obliquely relative to the longitudinal axis to receive an electrical connector from the electrical fixture as illustrated in FIGS. 18 and 20. Further, the rotatable mount is configured to rotate to a second position illustrated in FIGS. 17 and 19 such that the electrical connector is approximately parallel to the longitudinal axis. Additionally, the electrical connector may be biased inwardly from the mounting strap and into the junction box. The flanged portion 533 of the strap 530 may include a mechanical stop 538 configured to engage a detent 539 of the rotatable mount to limit its rotation in either direction.

In this configuration, the electrical connector from the electrical fixture may include an extension cord extending from the electrical fixture. The extension cord may have a plug to mate with or be inserted into the electrical connector 532 supported by the rotatable mount 531 to provide an electrical connection between the fixture and the junction box. Alternatively, the electrical fixture may have a push-on connector as described above which inserts into the push-on connector 532 of the strap to provide an electrical connection between the fixture and the junction box. Such a configuration allows an installer to easily couple the wires from the junction box to the strap as well as to easily couple the wires or the push-on connector of the light fixture thereto and arrange those wires out of the way of the fixture when mounting the fixture to the junction box.

So configured, the strap having a rotatable mount may reduce the amount of space required to electrically connect the electrical fixture to the junction box and facilitate easier handling of the electrical connections involved when mounting a fixture.

It is understood that the straps 430, 530 discussed herein may be constructed of a metal, plastic, or other similar electrically conductive materials utilized by those having skill in the art. If the strap 430, 530 is made of a metal or similar electrically conductive material, the electrical ground connection may be carried from the junction box to the mounting strap through physical engagement between the mounting strap and the junction box. In this approach, the electrical fixture is configured to connect to the electrical ground connection through an electrical fixture support, which may be a screw or similar devices, mating with the mounting strap. In such an approach, the push-on connectors 432, 532 must be electrically insulated from the grounded strap portions 437, 537 so as to avoid a short circuit at the junction box 120. Conversely, in the event the strap 430, 530 is made of a non-electrically conductive material, a separate grounded strap portion 437, 537 must be provided.

Figure 21:
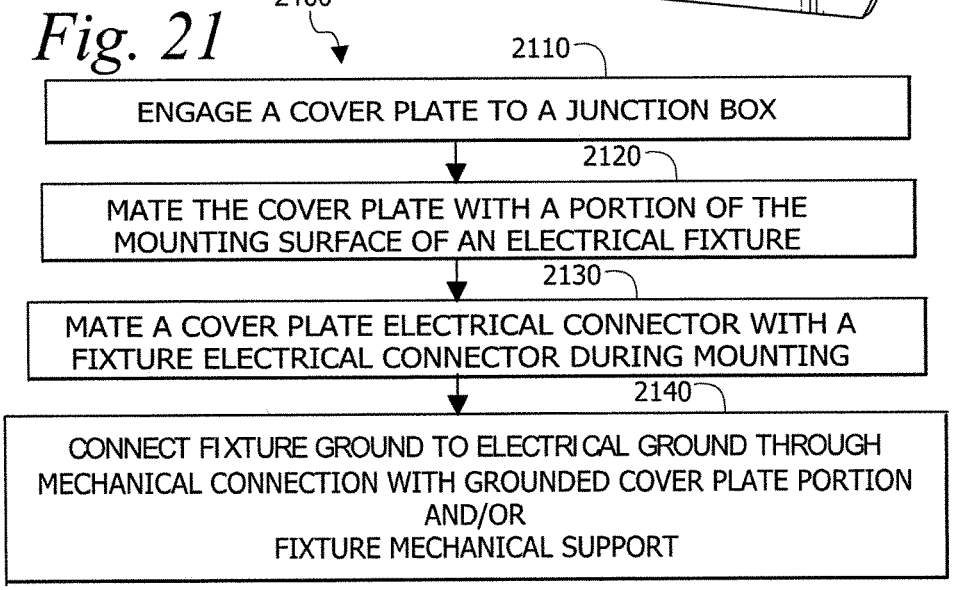
FIG. 21 comprises a flow chart of an example method of mounting an electrical fixture to a cover plate on a junction box as configured in accordance with various embodiments of the invention.

Turning to FIG. 21, an example method of mounting an electrical fixture to a cover plate on a junction box 2100 is illustrated. It is understood that in this method 2100, elements previously referenced operate in the manners also described herein. First, at step 2110, a cover plate having an electrical connector configured to electrically connect to hot and neutral lines from a junction box is engaged with the junction box.

Next, at step 2120, the cover plate is mated with a portion of a mounting surface of an electrical fixture. Next, at step 2130, a cover plate electrical connector is mated with a fixture electrical connector. At step 2140, fixture ground is connected to electrical ground through a mechanical connection with a grounded cover plate portion and/or with a fixture mechanical support.

In one approach, the method 2100 may further include the cover plate having a grounded cover plate portion separate from the electrical connector configured to electrically connect to electrical ground at the junction box. In this embodiment, the method further includes the grounded cover plate portion electrically connecting to electrical ground at the junction box. The grounded cover plate portion further electrically connects the electrical fixture to electrical ground through one or both of a mechanical connection between the grounded cover plate portion and at least a portion of the electrical fixture housing when the electrical fixture is mounted to the junction box or a mechanical support of the cover plate including the grounded cover plate portion. The mechanical support then mechanically secures the electrical fixture through connection to the electrical fixture support. The mechanical support's grounded cover plate portion electrically connects electrical ground to the electrical fixture support.

In another approach to the method 2100, the mechanical support may further receive a screw of the electrical fixture support, which secures the electrical fixture to the cover plate. Further, the mechanical support may connect electrical ground to the screw, whereupon the screw electrically connects the electrical fixture to electrical ground.

In another approach, the method 2100 may further include engaging a screw with a portion of the junction box when the electrical fixture is mounted thereto to electrically connect the screw to electrical ground. The screw then electrically connects the electrical fixture ground connection to electrical ground. In another approach, the method may further include the electrical fixture ground connection directly electrically connecting to a ground wire from the junction box.

In another approach to the method 2100, the mounting surface of the electrical fixture housing may further have at least one flanged portion spaced apart from the mounting surface. Additionally, the cover plate may further have at least one flanged portion spaced apart from a surface. The flanged portion of the mounting surface of the electrical fixture housing then slidably mates with at least a portion of the flanged portion of the cover plate to effect the cover plate electrical connector mating with the fixture electrical connector of the electrical fixture during mounting of the electrical fixture to the junction box.

In another approach to the method 2100, the flanged portion of the mounting surface of the electrical fixture housing may rotatably mate with at least a portion of the flanged portion of the cover plate to effect the cover plate electrical connector mating with the fixture electrical connector of the electrical fixture during mounting of the electrical fixture to the junction box.

In yet another approach to the method 2100, the mounting surface of the electrical fixture housing may further have a push-on connector. Similarly, the cover plate may further have a push-on connector. The push-on connector of the mounting surface of the electrical fixture housing is insertably mated with the push-on connector of the cover plate to effect the cover plate electrical connector mating with the fixture electrical connector of the electrical fixture during mounting of the electrical fixture to the junction box.

Those skilled in the art will recognize that a wide variety of modifications, alterations, and combinations can be made with respect to the above described embodiments without departing from the scope of the invention, and that such modifications, alterations, and combinations are to be viewed as being within the ambit of the inventive concept.

What is claimed is:

1. An electrical fixture connector comprising:

a mounting strap mountable to a junction box and a portion of a mounting surface of an electrical fixture;

the mounting strap having a longitudinal axis;

a rotatable mount supported by the mounting strap; and an electrical connector supported by the rotatable mount;

wherein when the mounting strap is mounted to the junction box, the rotatable mount is operable to:

rotate to a first position such that the electrical connector extends outwardly from the junction box and obliquely relative to the longitudinal axis to receive an electrical connector from the electrical fixture, and rotate to a second position such that the electrical connector is approximately parallel to the longitudinal axis and or biased inwardly from the mounting strap and into the junction box.

2. The electrical fixture connector of claim 1 wherein the mounting strap includes a flanged portion extending obliquely to the longitudinal axis of the mounting strap, wherein the flanged portion is configured to support the rotatable mount.

3. The electrical fixture connector of claim 2 wherein the flanged portion defines an aperture configured to receive a portion of the rotatable mount.

4. The electrical fixture connector of claim 3 wherein the rotatable mount is configured to rotate about the portion of the rotatable mount engaging the aperture of the flanged portion.

5. The electrical fixture connector of claim 2, wherein the flanged portion includes a mechanical stop configured to engage a detent of the rotatable mount to limit rotation of the rotatable mount.

6. The electrical fixture connector of claim 1 wherein an electrical connector from the electrical fixture includes push-on connector from the electrical fixture having a plug configured to mate with the electrical connector supported by the rotatable mount.

7. The electrical fixture connector of claim 1 wherein the electrical connector is integrally formed with the rotatable mount.

8. The electrical fixture connector of claim 1, wherein the mounting strap is constructed of an electrically conductive material such that an electrical ground connection is carried from the junction box to the mounting strap through physical engagement between the mounting strap and the junction box, wherein the electrical fixture is configured to connect to the electrical ground connection through an electrical fixture support mating with the mounting strap.

9. The electrical fixture connector of claim 8, wherein the electrical fixture support comprises an electrically conductive screw configured to secure the electrical fixture to the mounting strap.

10. The electrical fixture connector of claim 8, wherein the electrical connector is electrically insulated from the mounting strap.

11. An electrical fixture connector comprising:

a mounting strap mountable to a junction box and a portion of a mounting surface of an electrical fixture;

the mounting strap having a grounded portion and a mechanical support;

a rotatable mount supported by the mounting strap;

an electrical connector supported by the rotatable mount;

wherein when the mounting strap is mounted to the junction box, the rotatable mount is operable to receive an electrical connector from the electrical fixture, the mounting strap being an electrically conductive mounting strap such that an electrical ground connection from the junction box extends to the mounting strap through physical engagement between the mounting strap and the junction box;

the mounting strap grounded portion grounded along with the mounting strap mechanical support, the mounting strap mechanical support configured to electrically ground an electrical fixture grounded portion.

12. The electrical fixture connector of claim 11 including a screw electrically connecting the electrical fixture grounded portion to the mounting strap grounded portion and mechanical support.

13. An electrical fixture connector for mounting an electrical fixture to a mounting strap mounted to a junction box, the electrical fixture having an electrical fixture housing including a mounting surface, a fixture electrical connector disposed on the electrical fixture mounting surface, an electrical fixture support secured to the electrical fixture when mounted, and an electrical fixture ground connection separate from the fixture electrical connector, the mounting strap having a mounting strap electrical connector configured to electrically connect to hot and neutral lines from the junction box, the electrical fixture connector comprising:

the mounting strap engaging the junction box;

the mounting strap mating with at least a portion of the mounting surface of the electrical fixture;

the mounting strap electrical connector mating with the fixture electrical connector of the electrical fixture during mounting of the electrical fixture to the junction box;

the electrical fixture ground connection configured to electrically connect to an electrical ground from the junction box.

14. The electrical fixture connector of claim 13 wherein the mounting strap further includes a mounting strap grounded portion separate from the mounting strap electrical connector, the mountings trap grounded portion configured to electrically connect to electrical ground at the junction box, the electrical fixture apparatus further comprising:

the mounting strap grounded portion electrically connecting to electrical ground at the junction box;

the mounting strap grounded portion electrically connecting the electrical fixture to electrical ground through one or both of:

a mechanical connection between the mounting strap grounded portion and at least a portion of the electrical fixture housing when the electrical fixture is mounted to the junction box; or a mechanical support of the mounting strap including the mounting strap grounded portion, wherein:

the mechanical support mechanically secures the electrical fixture through connection to the electrical fixture support, and the mechanical support's mounting strap grounded portion electrically connects electrical ground to the electrical fixture support.

15. The electrical fixture connector of claim 14 further comprising:

the mechanical support receiving a screw of the electrical fixture support that secures the electrical fixture to the mounting strap;

the mechanical support connecting electrical ground to the screw; and the screw electrically connecting the electrical fixture to electrical ground.

16. The electrical fixture connector of claim 14 wherein the electrical fixture support comprises a screw, the electrical fixture connector further comprising:

the screw engaging a portion of the junction box when the electrical fixture is mounted to the junction box to electrically connect the screw to electrical ground; and the screw electrically connecting the electrical fixture ground connection to electrical ground.

17. The electrical fixture connector of claim 14 further comprising the electrical fixture ground connection electrically connecting to a ground wire from the junction box.

18. The electrical fixture connector apparatus of claim 13 wherein the mounting surface of the electrical fixture housing further comprises a push-on connector and the mounting strap further comprises a push-on connector, the electrical fixture connector further comprising:

the push-on connector of the mounting surface of the electrical fixture housing insertably mating with the push-on connector of the mounting strap to effect the mounting strap electrical connector mating with the fixture electrical connector of the electrical fixture during mounting of the electrical fixture to the junction box.

* * * * *